US005826481A

United States Patent [19]

Sintonen

[11] Patent Number: 5,826,481

[45] Date of Patent: Oct. 27, 1998

[54] DEVICE FOR CUTTING PLYWOOD VENEER

[76] Inventor: Kari Sintonen, Aumakatu 16, SF-15700 Lahti, Finland

[21] Appl. No.: 610,131

[22] Filed: Feb. 29, 1996

Related U.S. Application Data

[63] Continuation-in-part of Ser. No. 253,231, Jun. 2, 1994, abandoned, which is a continuation of Ser. No. 78,188, Jun. 22, 1993, abandoned.

[30] Foreign Application Priority Data

Jun. 26, 1991 [FI] Finland ..... 913111
Mar. 27, 1992 [FI] Finland ..... PCT/FI92/00091

[51] Int. Cl.[6] ..... B26D 1/12

[52] U.S. Cl. ..... 83/664; 83/674; 83/343; 144/332; 144/356

[58] Field of Search ..... 83/664, 665, 343, 83/346, 331; 144/332, 356

[56] References Cited

U.S. PATENT DOCUMENTS

| | | | |
|---|---|---|---|
| 2,615,376 | 10/1952 | Pelikan . | |
| 3,552,252 | 1/1971 | Maxey et al. | 83/365 X |
| 3,673,907 | 7/1972 | Watanabe . | |
| 3,808,925 | 5/1974 | Hards . | |
| 4,020,724 | 5/1977 | Quinlan . | |
| 4,276,797 | 7/1981 | Baumann et al. | 83/346 X |
| 4,341,525 | 7/1982 | Wittkopf | 83/344 X |
| 4,397,204 | 8/1983 | Colombo . | |
| 4,682,639 | 7/1987 | Takeda et al. | 83/367 X |
| 4,726,271 | 2/1988 | McEwan . | |
| 4,732,067 | 3/1988 | Yamada . | |
| 4,742,745 | 5/1988 | Cremona | 83/346 X |
| 4,794,962 | 1/1989 | Knudson | 83/371 X |
| 4,960,023 | 10/1990 | Reuter et al. | 83/368 |
| 4,970,924 | 11/1990 | Capdeboscq . | |
| 5,001,950 | 3/1991 | Fokos et al. . | |
| 5,017,184 | 5/1991 | Takahori et al. | 83/343 X |
| 5,035,164 | 7/1991 | Cremona | 83/371 X |
| 5,367,936 | 11/1994 | Held et al. | 83/674 X |
| 5,383,504 | 1/1995 | Cremona | 83/106 X |

*Primary Examiner*—Maurina T. Rachuba
*Attorney, Agent, or Firm*—Armstrong, Westerman, Hattori, McLeland & Naughton

[57] ABSTRACT

A knife assembly for a veneer cutting apparatus, which includes at least two cutting blades mounted on a shaft. The cutting blades are independently rotatable to permit cutting of the veneer across its entire length or across a portion thereof.

2 Claims, 3 Drawing Sheets

DEVICE FOR CUTTING PLYWOOD VENEER

This application is a continuation-in-part of U.S. patent application Ser. No. 08/253,231, filed Jun. 2, 1994, abandoned, which is a continuation of application Ser. No. 08/078,188, filed Jun. 22, 1993 abandoned, which is the National Stage of International Application No. PCT/FI92/00091, filed Mar. 27, 1992.

BACKGROUND OF THE INVENTION

1. Field of the Invention

The object of the invention is to provide a device for cutting plywood veneer.

2. Description of the Related Art

U.S. Pat. No. 3,808,925 to Hards, incorporated herein by reference, is considered the pioneer invention of the so-called rotary cutting of veneer. In this patent, a rotary clipper for veneer is provided having a thin blade which cuts through veneer while moving in the same direction as the veneer while the latter moves over a supporting drum. The blade has an edge opposite its cutting edge which bears against a bracing while the blade cuts through the veneer. The drum and blade are synchronized and rotated so that the cutting edge of the blade moves over the face of the drum at the same speed as the veneer moves over that drum. When defects are sensed in the veneer, the blade is rotated to execute first and second cuts which cut the defect from the veneer.

When veneer is peeled from the surface of a rough log the leading end of the peeled veneer with certainty contains holes or bites which must be cut off. In the apparatus disclosed in the U.S. Pat. No. 3,808,925, the cutting is effected across the entire veneer web just ahead and just behind the defective part of the web. This proceeding leads, however, to a waste of the veneer material because the defective spots usually are very limited in the width direction of the veneer web. This direction across the veneer web equals to the log length direction and is used among the artisans to depict also the length direction of the veneer sheets cut from the web.

A known solution to this waste problem has been to slit the peeled veneer with a cut in the travelling direction of the peeled veneer web, as long as the web contains defective spots. The slitting can be effected in the peeling lathe with an auxiliary blade device, or in a separate slitting device positioned after the lathe. The slitting is usually effected in the middle of the web. The web halves are thereafter usually processed separately, either consecutively in one clipping device or in two separate clipping devices, in order to cut off the defective spots from the veneer. The resulted half length veneer sheets, which may have a full width of less, are used for middle layers in plywood. When the rounding off stage of the veneer peeling procedure is completed, and the veneer peeled from here further is sound, the slitting is disconnected and veneer sheets are clipped in full width dimensions.

SUMMARY OF THE INVENTION

The device is intended for cutting the veneer web issuing forth from a plywood lathe. The cutting is considered to include both the slitting and clipping operations above referred to. The cutting is executed either so that the faulty spots are cut off or the veneer web, when sensed, as not containing faulty spots is clipped into sheets of certain width at set intervals. The device is especially intended for a veneer cutting application in which the veneer web peeled off a log is slit into two parts in the longitudinal direction, i.e. in the direction of motion of the veneer web in so far as the web has faulty spots. The slitting is normally executed essentially along the middle of the web. Following the implementation of this method, the faults are removed independently from either part of the veneer web, when the parts are running side by side through a common clipper device, whereas the sound part of the web is clipped to set widths along the entire web in the same clipper without slitting it.

While the method does save web, because faulty spots seldom extend very far across the web, it also imposes great demands on the clipping apparatus. In applications of this method it is known for more than one clipper to be used; that is to say, two narrow clippers are used for cutting off the faulty spots in the two halves of the web and one full-size clipper is used for cross cutting complete web sections. Alternatively both the slitted webs of a half width and the whole web are clipped consecutively in a full size clipper which considerably diminishes the capacity of the clipper.

The invention that is the subject of this application brings about an essential improvement in that it is possible to execute both the cutting off of faulty spots in the web halves as well as the clipping into set widths of complete web section. According to the invention, a full scale veneer clipper capable of clipping across the entire veneer web is modified to be able to effect both the clippings of the web produced in the rounding stage of the veneer peeling procedure as well as in ordinary peeling stage. This modification of the veneer clipper is achieved by the special cutting (clipping) blade construction and by its control apparatus.

The device in accordance with the invention is based on what may be called the technique of a rotary-blade clipper which embodies a cutting blade reaching across the web to be cut, the cutting blade lending itself to be rotated in a controlled manner into cutting contact with a selected cutting point on the veneer web. The rotary motion of the blade has been selected to be such that it complies with the forward motion of the veneer web whereupon the blade does not cause the veneer web to be arrested on being cut.

Usually this type of a cutting blade works in unison with a roller supporting the veneer web or with a corresponding opposing member against which the blade is forced in order for the cutting action to be executed. The blade can be made sufficiently massive for the cutting operation to occur successfully. The massiveness of the blade may be achieved, for instance, by making the blade shaft sufficiently solid. Alternatively, the cutting apparatus may embody an abutting member on the side opposite to the blade, the abutting member providing the blade with support for the cutting operation to be executed. The stiffness of a structurally light blade can be increased by subjecting the blade shaft to tensile stress when in use.

In accordance with the invention, the blade element is divided into two consecutive sections along its shaft, the rotational position of the elements being such that they can be controlled independently.

BRIEF DESCRIPTION OF THE DRAWINGS

The invention is described by means of the appended drawings, wherein.

DETAILED DESCRIPTION OF THE PREFERRED EMBODIMENTS

Figure 1:
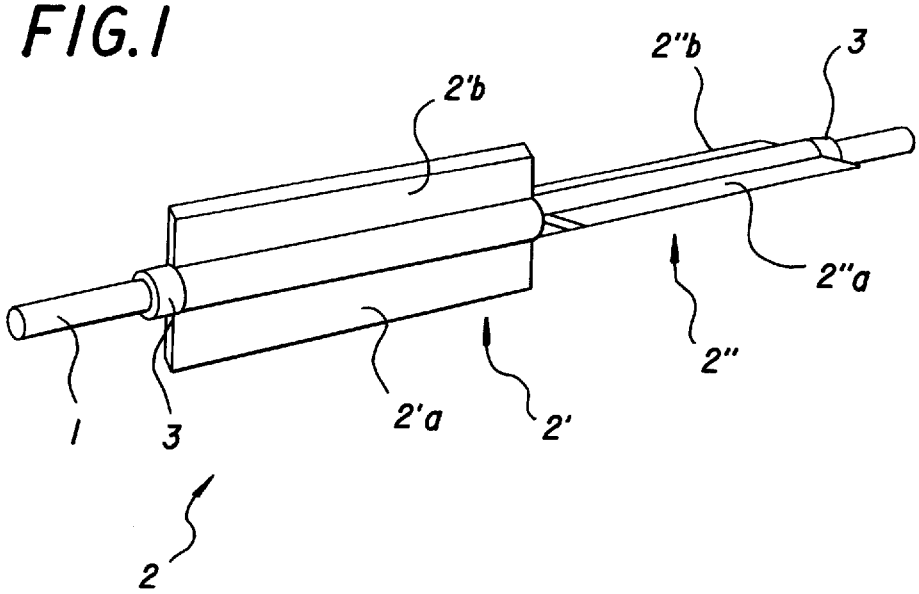
FIG. 1 is one view of the inventive blade arrangement of the present invention showing the independent operation of the blades.
Figure 2:
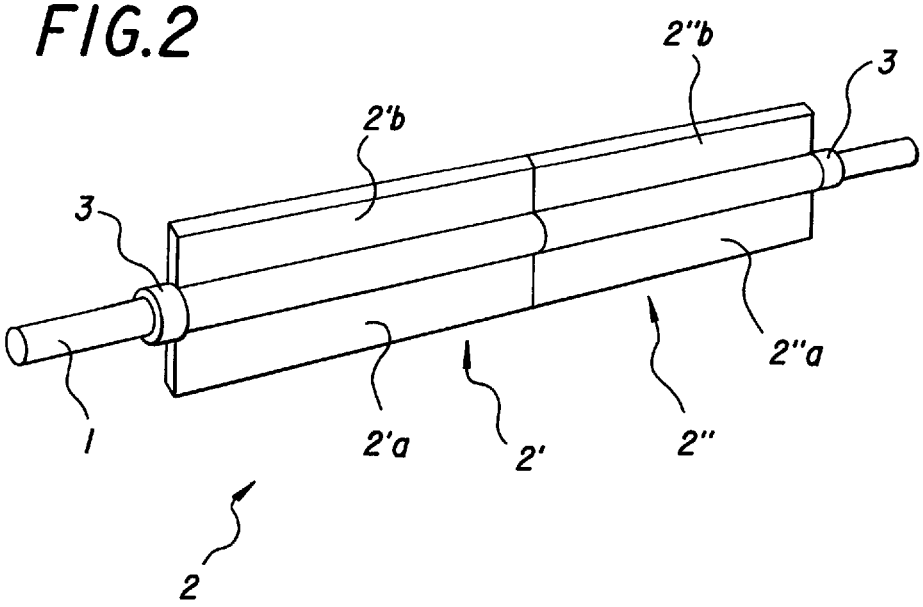
FIG. 2 is another view of the inventive blade arrangement of the present invention with the blades in unison.

FIGS. 1 and 2 show the blade arrangement in accordance with the invention. The blade arrangement embodies a shaft 1 reaching across the entire veneer web that is to be cut and two blade elements 2' and 2" supported by it. The blade elements may be rotated independently on the shaft 1 and they are provided with their own rotating apparatus. The above-described blade arrangement of the present invention can be mounted in a rotary veneer clipper substantially as described in U.S. Pat. No. 3,808,925, with the exception for providing independent control of the blade elements 2' and 2". In particular, each blade element 2' and 2" is provided with individual means for rotation. The rotating means for a single blade described in U.S. Pat. No. 3,808,925 can be used in the present invention by providing such means for each blade element 2' and 2" attached at shaft 3 shown in FIGS. 1 and 2. Therefore, a description is not provided herein of the various sprockets and gears in such a drive system, it being understood that those of ordinary skill in the art can employ the teachings of U.S. Pat. No. 3,808,925.

Figure 3:
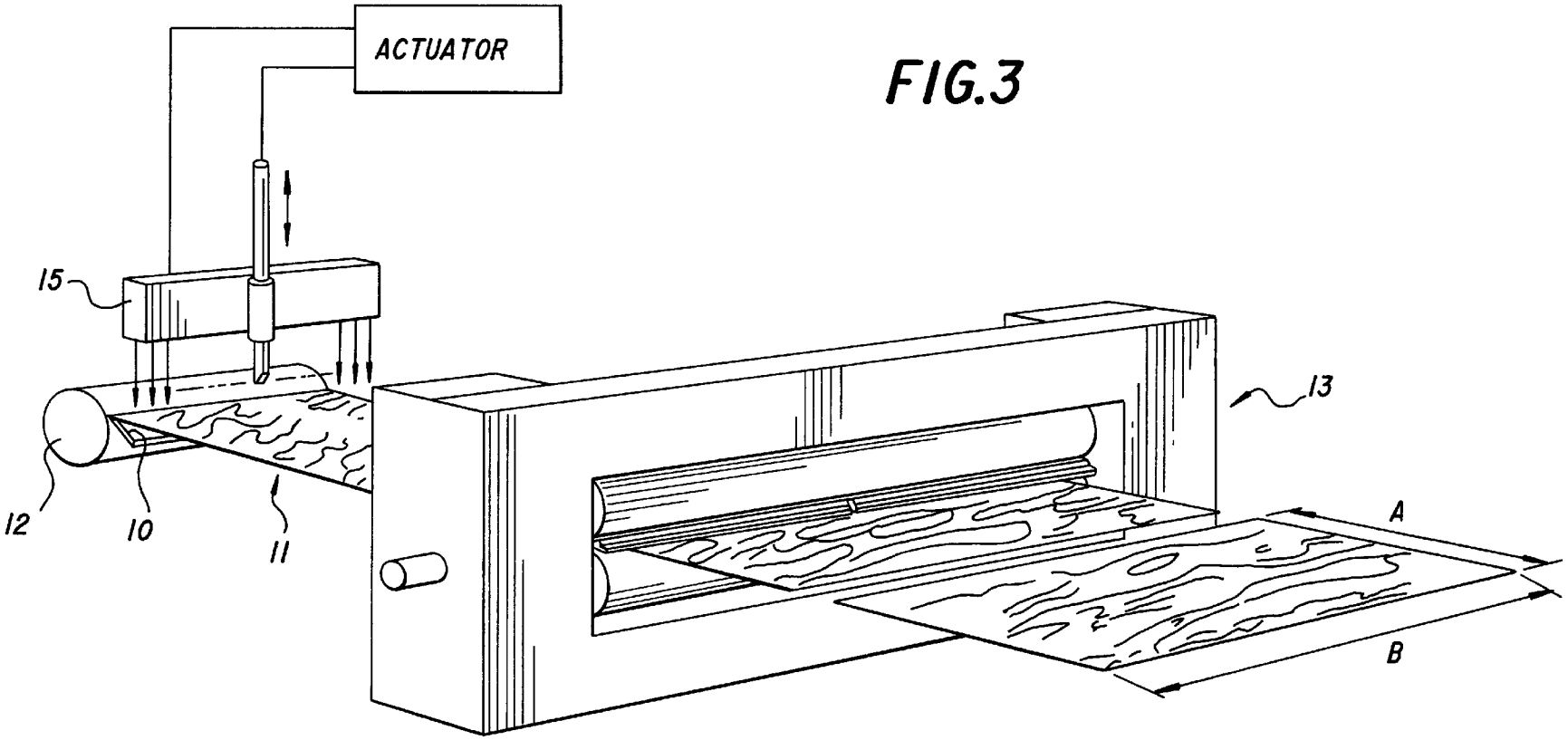
FIGS. 3 and 4 are perspective views of the operation of the apparatus of the invention.

A further explanation of the present invention is made with reference to FIG. 3. FIG. 3 depicts the normal operation of the apparatus in the case when no defects are detected by a sensor 15. In such an operation, the veneer can be cut at set widths. In general, a peeling blade 10 peels veneer 11 from log 12. The veneer 11 is fed to the rotary veneer clipper 13 which houses the blade structure 2. The blade structure 2 cuts the veneer 11 to a preset width A by operating in unison (as shown in FIG. 2).

According to common practice in this field, and referred to above, the length B of a veneer sheet is the dimension in the fiber direction of the sheet, i.e. in the length direction of the log from which the veneer is peeled (marked as B in FIG. 3). The width of a veneer sheet is the dimension A in FIG. 3, i.e. the dimension of the sheet in the traveling direction of the peeled veneer web.

Figure 4:
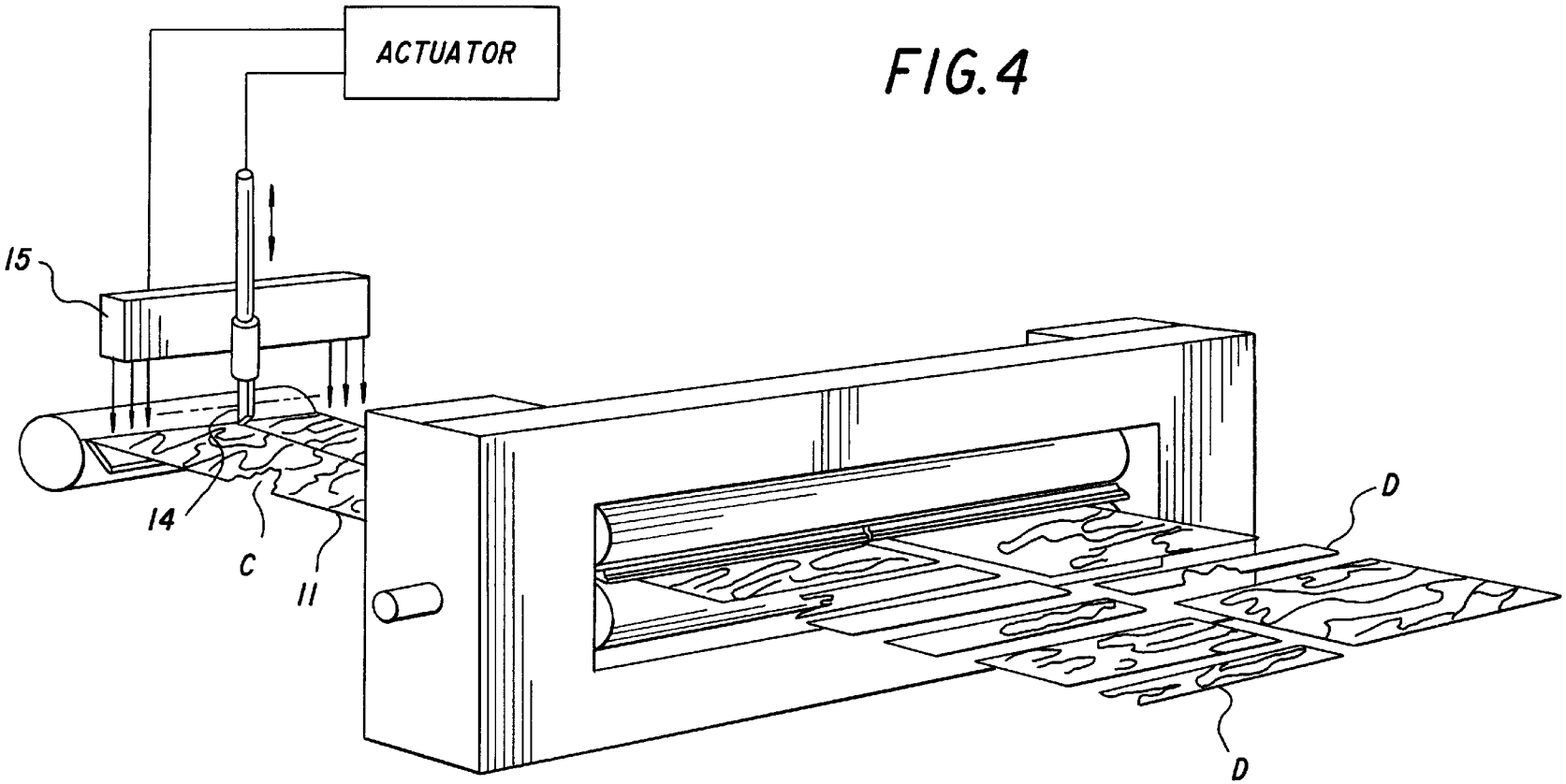

When veneer is peeled from the surface of the rough log 12, the leading end of the peeled veneer inevitably contains holes or bites C (FIG. 4) which must be cut off. In the apparatus of U.S. Pat. No. 3,808,925, the cutting is performed across the entire length B of the veneer web just ahead and just behind the defective part of the web containing the bite C. This procedure, however, results in considerable waste of the veneer material because the defective spots are usually very limited in the length B across the veneer web.

The present invention provides the sensor 15 which not only detects a defect, but also notes the size and location of the defect. The location of the defect can be determined as limited to the side extending across blade element 2' or blade element 2". If a defect is detected in one of these areas, an actuator such as a hydraulic cylinder presses a blade 14 into cutting contact with the veneer web 11. The veneer web 11 is cut for a distance sufficient to remove the defective portion of the web, whereupon the actuator lifts the blade 14 out of cutting contact when slitting is not required. When the slit veneer web passes underneath the blade structure 2, and it contains random faults on one half or the other or simultaneously on both halves, the blade elements 2' and 2" execute cutting operations on the web halves independently of one another in order to remove faulty spots as waste D from their respective halves.

Once the peeling of the veneer web 11 has proceeded onto the sound part of the peeled log, the slitting of the veneer web coming to the slitter is discontinued and the control for the blade elements 2' and 2" are combined to obey the same command, this command usually being to cut the veneer web into sheets of certain width A, as shown in FIG. 3. When executing this function, the blade elements 2' and 2"0 are, of course, angularly in unison with one another (FIG. 2) and form a contiguous blade reaching across the veneer web. The joint-function contiguous blade structure 2 may include situations in which the veneer web contains faulty spots extending across each half that need to be removed. When this is the case, the faulty spots are cut off in strips extending across the entire length B of the veneer web by the blade elements 2' and 2" working in unison.

Blade elements 2' and 2" may be composed of two blades each 2'*a*, 2'*b*, and 2"*a*, 2"*b*, respectively, such that all four are blades positioned at even angles on shaft 1. Even one blade per blade element 2' and 2" forms a functioning solution.

What is claimed is:

1. A knife assembly for a veneer cutting apparatus, the knife assembly comprising an elongated shaft having two opposite free ends for supporting the shaft on a frame construction of the veneer cutting apparatus, and two blade elements rotatably supported on the shaft between the free ends of the shaft, said blade elements each having a cutting blade projecting in a plane of the shaft, each of the blades having at least one cutting edge parallel to the shaft, wherein each of the cutting blade being rotatable on the shaft independent of rotation of the other cutting blade element, said blade elements forming a contiguous blade extending across the shaft when in unison with each other.

2. A knife assembly of claim 2, wherein each of the cutting blade elements have two opposite cutting edges on a same distance from the shaft.

* * * * *